US005460119A

United States Patent [19]

Maroszek

[11] Patent Number: 5,460,119

[45] Date of Patent: Oct. 24, 1995

[54] DEVICE FOR COATING A WEB OF MATERIAL GUIDED ABOUT A COUNTER-ROLLER PARTICULARLY A PAPER OR CARDBOARD WEB

[75] Inventor: Herlbert Maroszek, Düsseldorf, Germany

[73] Assignee: Jagenberg Aktiengesellschaft, Dusseldorf, Germany

[21] Appl. No.: 39,203

[22] PCT Filed: Sep. 3, 1992

[86] PCT No.: PCT/EP92/02031

§ 371 Date: Aug. 5, 1993

§ 102(e) Date: Aug. 5, 1993

[87] PCT Pub. No.: WO93/05223

PCT Pub. Date: Mar. 18, 1993

[30] Foreign Application Priority Data

Sep. 11, 1991 [DE] Germany ..... 41 30 118.8

[51] Int. Cl.[6] ..... B05C 5/02; B05C 1/08

[52] U.S. Cl. ..... 118/244; 118/246; 118/258; 118/263; 118/413

[58] Field of Search ..... 118/244, 246, 118/256, 258, 261, 263, 413, 419; 101/155, 157, 169

[56] References Cited

U.S. PATENT DOCUMENTS

| | | | |
|---|---|---|---|
| 3,070,066 | 12/1962 | Faeber | 118/413 |
| 3,070,461 | 12/1962 | Beachler | 118/413 X |
| 3,678,849 | 7/1972 | Musgrave | 101/157 |
| 3,799,111 | 3/1974 | Damrau | 118/63 |
| 4,029,833 | 6/1977 | Kosta | 427/428 |
| 4,405,661 | 9/1983 | Alheid | 427/356 |
| 4,651,547 | 3/1987 | Morel et al. | 72/8 |
| 4,688,516 | 8/1987 | Sommer | 118/410 |
| 4,706,603 | 11/1987 | Wohlfeil | 118/410 |
| 5,018,258 | 5/1991 | Niskanen | 29/116.2 |
| 5,031,435 | 7/1991 | Seto et al. | 72/247 |
| 5,085,168 | 2/1992 | Sollinger | 118/126 |
| 5,107,788 | 4/1992 | Boldrini et al. | 118/212 |
| 5,109,792 | 5/1992 | Baldini | 118/410 |
| 5,117,767 | 6/1992 | Sommer | 118/126 |
| 5,136,941 | 8/1992 | Lubke et al. | 101/157 |
| 5,138,970 | 8/1992 | Sollinger | 118/126 |
| 5,186,753 | 2/1993 | Nakazawa et al. | 118/410 |
| 5,302,203 | 4/1994 | Zimmer | 118/117 |

*Primary Examiner*—James C. Housel
*Assistant Examiner*—Harold Y. Pyon
*Attorney, Agent, or Firm*—Herbert Dubno

[57] ABSTRACT

In a device for coating a web of material, particularly a paper or cardboard web, the swivel mechanism of the coating mechanism and/or of the dosing system each have in addition to the cylinder units effecting the swinging motion from the servicing position into the working position, a hydraulic piston-cylinder unit pressing the swivel arms from the working position into an intermediate position. In this way the coating mechanism and/or the dosing system can be swung every quickly into the working position at the counter-roller and also swung away very quickly from the latter.

4 Claims, 4 Drawing Sheets

DEVICE FOR COATING A WEB OF MATERIAL GUIDED ABOUT A COUNTER-ROLLER PARTICULARLY A PAPER OR CARDBOARD WEB

CROSS-REFERENCE TO RELATED APPLICATIONS

This application is a national phase of PCT/EP92/02031 filed Sept. 3, 1992 and based, in turn, on German national application P41 30 118.8 filed Sept. 11, 1991 under the International Convention.

TECHNICAL FIELD

The present invention relates to a device for coating a web of material guided about a counter-roller, particularly a paper or cardboard web.

BACKGROUND OF THE INVENTION

Known devices for the coating of running paper or cardboard webs have a coating mechanism swingable towards the web in the area where it wraps about the counter-roller and apply an excess of coating material e.g. coating paint. This portion of the mechanism is followed in the running direction of the web by a dosage system with a dosing element (e.g. a doctor blade) which wipes the excess off, down to the desired coating level.

From DE 39 16 620-A1 (Corresponding to U.S. Pat. No. 5,117,767) describes a device of this kind is known wherein the coating mechanism comprises an application roller drawing liquid from a liquid chamber and which is swingably supported with respect to the counter-roller. In the working position a narrow clearance (coating gap) is left between the coating roller and the counter-roller, this gap being completely filled by the provided coating paint. The coating mechanism can be swung away into a servicing position for maintenance, e.g. cleaning.

The dosing system comprises a doctor beam swingable towards the counter-roller with a doctor blade as a dosing element which can be pressed against the web supported by the counter-roller with an adjustable pressure and at a preselected angle, for the purpose of dosing the weight of the coating. The doctor beam with the dosing element can also be swung into a servicing position, e.g. for replacement of the doctor blade.

In a high-speed coating installation (web speed>600 m/min) it is required to swing the coating mechanism and/or the dosing system quickly and accurately in the respective working position at the counter-roller. It is also often necessary to swing the coating or dosing mechanism away very quickly from the respective working position, e.g. for instance when it passes a joint with a web splice, or in the case of defective spots or in the case of a web break. If the coating mechanism as well as the dosing system are supposed to be swung back and forth quickly, it becomes necessary to precisely coordinate the timing of the two swinging motions. On the one hand it has to be prevented that an undosed paint film is applied which would contaminate subsequent installation parts and soften and weaken the web, with the consequence of breaks in the web. On the other hand, a doctor blade should only be pressed against a dry web for a short period of time, because otherwise it can heat up and burn out due to high friction.

OBJECT OF THE INVENTION

It is the object of the invention to create a coating device of the aforementioned kind, wherein the coating mechanism and/or the dosing system can be brought very quickly to its working position at the counter-roller, as well as be very quickly swung away from this position.

This object is achieved in a device for coating a web of material, particularly a paper or cardboard web, guided about a counter-roller, with a coating mechanism fastened to pivot arms, whose coating element, particularly a coating roller can be swung from a servicing position into the working position at the counter-roller. The dosing system is fastened to pivot arms whose dosing element (doctor blade) is also swingable from a servicing position into a working position at the counter-roller. According to the invention the pivot mechanism of the coating mechanism and/or the dosing system each comprises, in addition to the piston-and-cylinder unit effecting the swinging motion from the servicing position into the working position, a hydraulic piston-and-cylinder unit which presses the swivel arms from the working position into an intermediate position.

According to the invention when the coating mechanism and/or the dosing system are swung from the servicing position into the working position, they are first brought to an intermediate position by a first pneumatic or hydraulic (piston-)cylinder unit. In the intermediate position the coating mechanism, or the dosing system, has the shortest possible but sufficient distance from the counter-roller, but one that is sufficient so that no coating or dosing takes place. A second hydraulic piston-and-cylinder unit in the area between the working position and the intermediate position is capable to counteract the effect of the first piston-and-cylinder unit, i.e., to push away from the counter-roller.

For the rapid swinging towards the counter-roller, first the counterpressure of the second piston-and-cylinder unit holds the coating mechanism or the dosing system in the intermediate position against the pressure force of the first piston-and-cylinder unit. Through the return stroke of the second piston-and-cylinder unit the coating mechanism or the dosing system is very quickly brought into the working position, whereby the first piston-and-cylinder unit acts as a spring under tension. It is possible to set exactly the distance to the counter-roller in the working position by precisely adjusting the stroke which presses the piston of the second piston-and-cylinder unit into the retracted end position.

For a quick swinging away from the working position to the intermediate position, the piston presses against the adjustable stop, thus acting against the effect of the retaining force of the first piston-and-cylinder unit, which for this reason is set to be much lower than the force of the second piston-and-cylinder unit. The swinging into the servicing position takes place either due to the weight of the coating mechanism itself, or the weight of the dosing system or by the action of the first piston-and-cylinder unit which either pulls away from the counter-roller or presses in its direction.

The piston of the piston-and-cylinder unit can press against an adjustable stop in order to effect the swinging motion form the working position into the intermediate position. The piston-and-cylinder unit can be fastened to the stand or to pivot arms in such a manner and the stroke of their pistons can be so designed that the coating mechanism or the dosing system assumes the working position when the piston is in retracted position.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
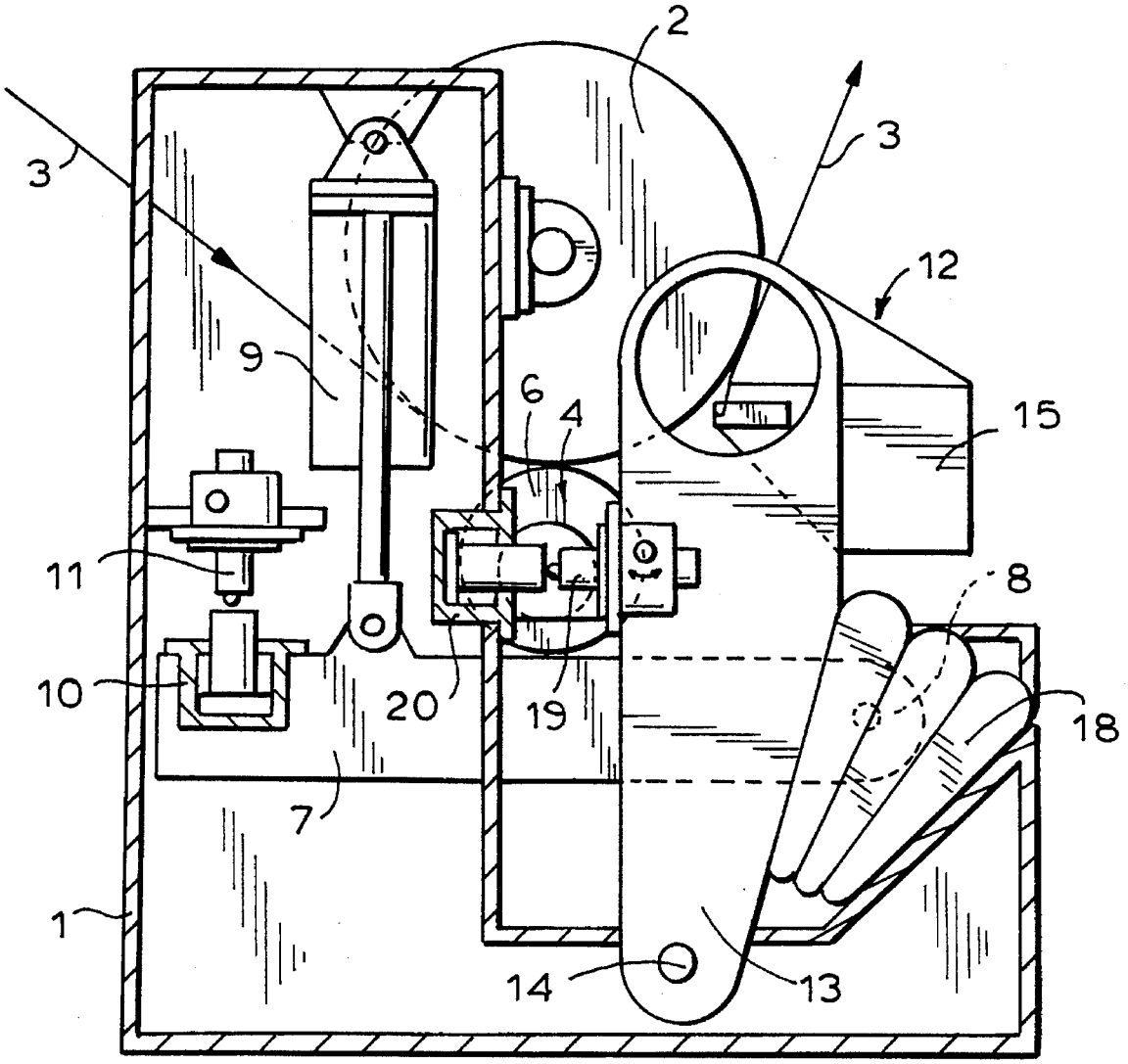
FIG. 1 is a cross sectional view which shows in a roughly schematic manner the lateral view of a coating device wherein the coating mechanism and the dosing system are swingably supported according to the invention.
Figure 2:
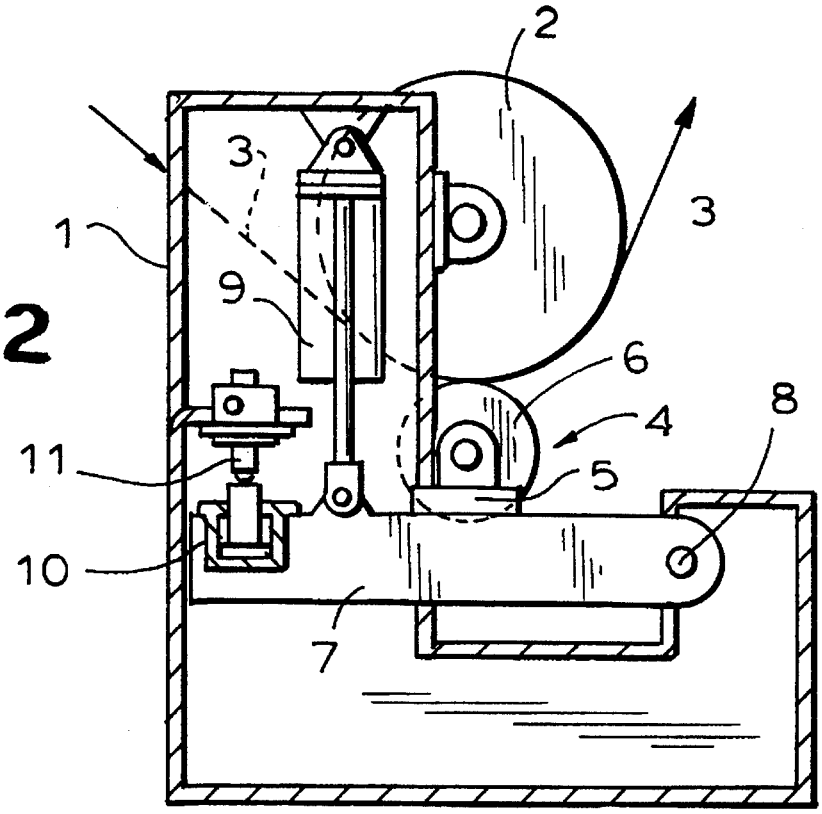
FIG. 2 is a similar view which shows the support of the coating mechanism in a roughly schematic manner.

The stand 1 (FIG. 1) of the coating device supports a driven counter-roller 2 extending over the work width partially wrapped by the web of material 3, which can be a paper or cardboard web. Underneath the counter-roller 2 a coating mechanism 4 having as a coating element a coating roller 6 drawing liquid from a liquid chamber 5 (FIG. 2) is supported on lateral swivel arms 7 so that it can be swung up and down. In FIG. 2 the pivot mechanism of the coating mechanism 4 is separately illustrated:

Two swivel arms 7, of which only one is visible in FIG. 2, extending approximately horizontally and supported swingably about axis 8 on both sides of stand 1, only one of these arms being visible in FIG. 2, carry on their upper side the driven coating roller 6 and the liquid chamber 5 from which the roller draws the coating paint, directs it into the application gap and applies it to the web 3. The piston of a first, approximately vertical piston-and-cylinder unit 9 is linked to the free, unpivoted end of the swivel arms 7. The cylinder is suspended on the stand 1. The stroke of the preferably pneumatic piston-and-cylinder unit 9 is selected so that the coating roller 6 can be swung from its upper working position, wherein it creates a narrow application gap with the counter-roller 2 in the area where the latter is wrapped by the web 3, to a lower servicing position.

At the end of each of swivel arms 7 a second hydraulic piston-and-cylinder unit 10 is mounted parallel to the first piston-and-cylinder unit 9, which means also approximately vertically. Its piston presses upwards against a stop 11, whose distance to the piston can be adjusted. When it is extended, the piston 10 presses against the stop 11 and thereby pushes the swivel arm 7 with the coating mechanism 4 downwards and away from the counter-roller 2. The stroke of the second piston-and-cylinder unit 10 and its distance from stop 11 is selected so that the coating roller 6 assumes its working position when the piston-and-cylinder unit 9 has pulled the swivel arm 7 so far upwards that the retracted piston of the piston-and-cylinder unit 10 rests against the stop 11. In this way the working position can be very precisely set by means of the height-adjustable stop 11. When the piston of the piston-and-cylinder unit 10 is extended in its end position, the coating roller 6 is in an intermediate position, wherein coating paint is no longer applied to web 3. In the intermediate position it is either held by the first piston-and-cylinder unit 9 or it is lowered all the way down into the servicing position, wherein together with the liquid chamber 5 it becomes very accessible to maintenance work.

Figure 3:
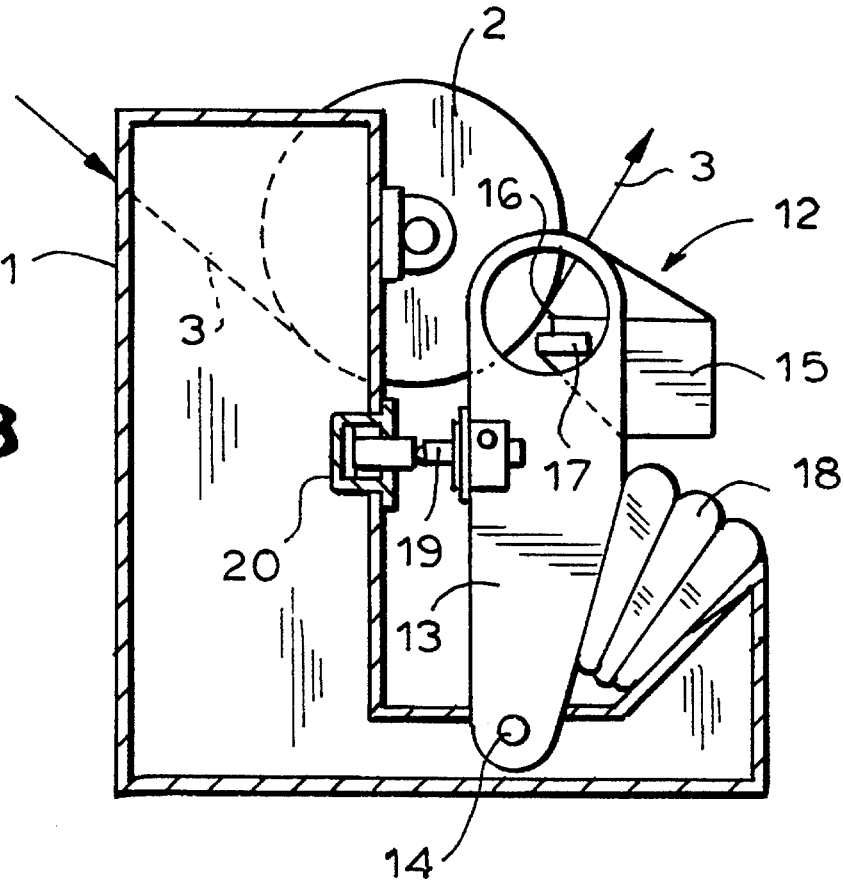
FIG. 3 is another lateral section which shows the support of the dosing system in a roughly schematic manner.

Behind the coating mechanism 4 in the running direction of the web a dosing system 12 is swingably supported in the stand 1 and its construction principle is separately illustrated in FIG. 3:

At the lower part of stand 1 on each side of the device a pivot arm 13 is supported so that it can be swung up and down about axis 14. At their free ends the pivot arms 13 carry a doctor beam 15 extending over the work width to which a dosage element, in the present example a doctor blade 16, is fastened with its base in a clamping ledge 17. The doctor beam 15 is swingable with respect to the pivot arms 13, in order to set the angle between the doctor blade 16 and the tangent at the counter-roller 2. Such a dosing system is known and is described for instance in DE 28 25 907-A1.

In order to swing the doctor blade 16 towards or away from the web 3 supported on counter-roller 2, each of the pivot arms 13 is connected with a pneumatic bellows 18 resting on stand 1. On the side facing away from the bellow cylinder 18 an adjustable stop 19 is mounted, which when the swivel arms 13 are swung upwards, i.e. when the dosing system is swung towards the counter-roller 2, is moved against the piston of a hydraulic piston-and-cylinder unit 20 mounted in stand 1.

Figure 4:
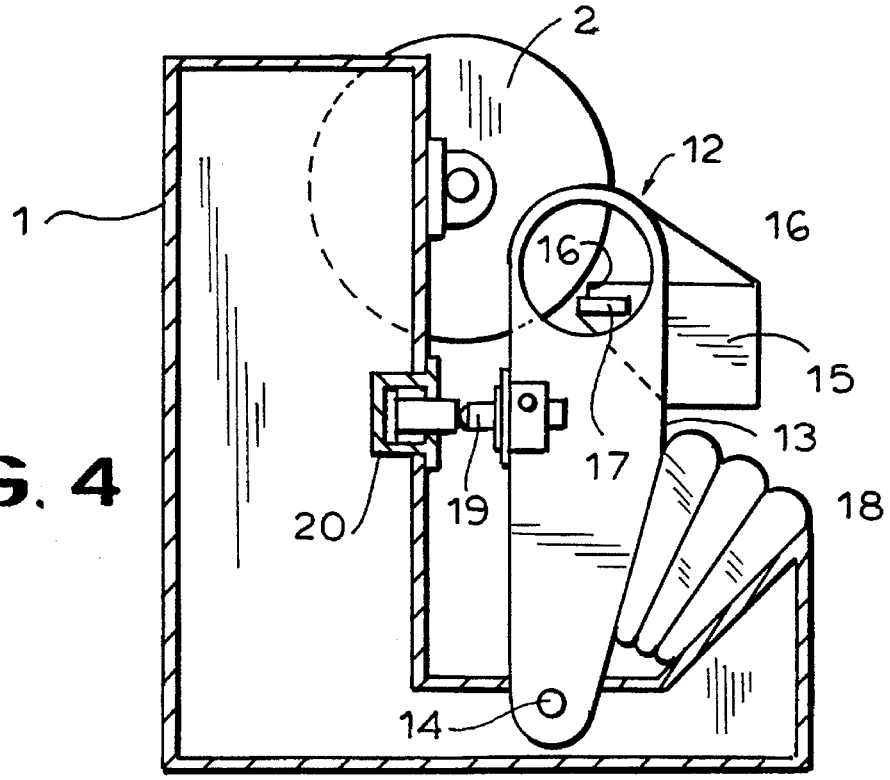
FIGS. 4 to 6 are views similar to FIGS. 1–3 whose views show the working, intermediate and servicing position of the dosing system according to FIG. 3.
Figure 5:
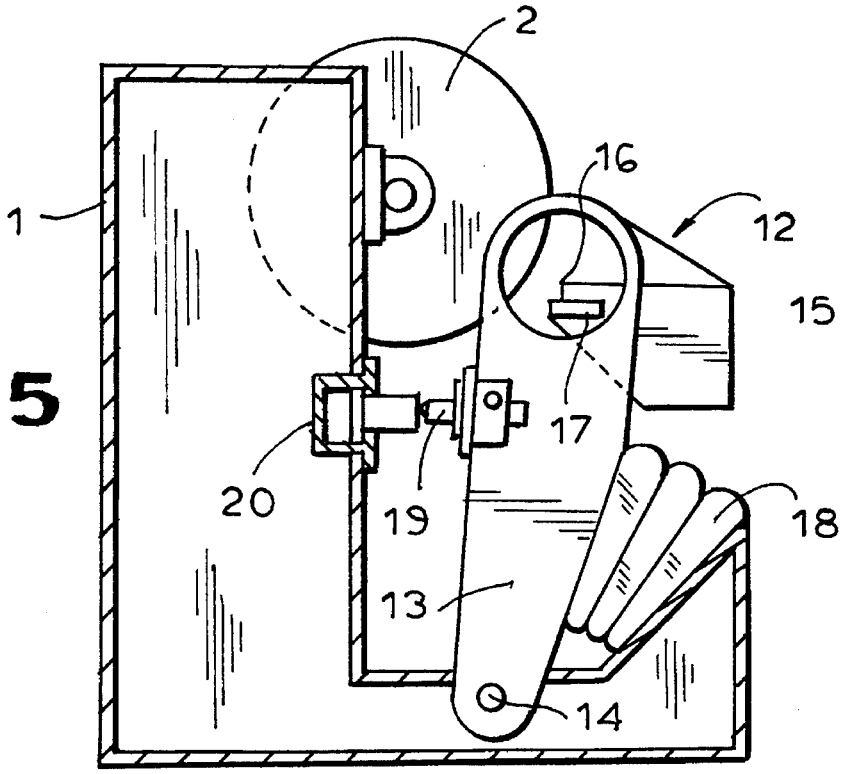
Figure 6:
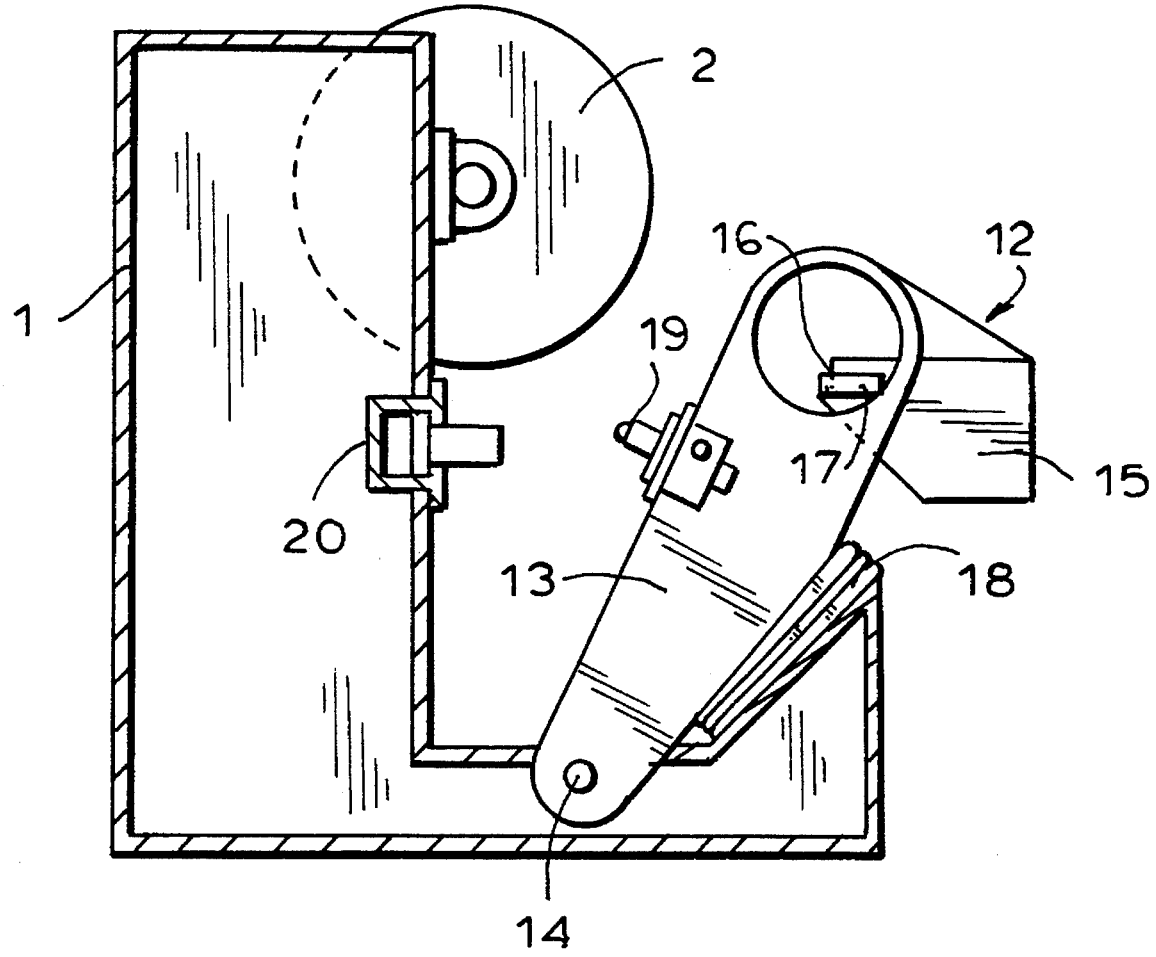

The piston-and-cylinder unit 20 is arranged approximately horizontally, so that in an extended position its piston presses the doctor beam 15 with the doctor blade away from counter-roller 2 approximately radially. The stroke of the piston-and-cylinder unit 20 and its position with respect to stop 19 is selected so that the piston in retracted position—as shown in FIGS. 3 and 4—in cooperation with the adjustable stop 19 establishes the working position wherein the doctor blade 16 is pressed against web 3. When the piston is completely extended, the dosing system 12 is in an intermediate position with sufficient distance between the doctor blade 16 and the counter-roller 2, so that also thickened splice spots can pass through without any problem. This position is shown in FIG. 5. From the intermediate position the dosing system 12 can be lowered further by means of the bellows 18 into a servicing position as shown in FIG. 6. In the servicing position the dosing system 12 is easily accessible, so that for instance the doctor blade 16 can be replaced. In this position also a new web 3 can be inserted without problems.

Instead of a doctor blade 16 it is also possible to use other dosing elements, such as a wiper rod or a scraper bar.

When the device starts operating, after the web 3 has been inserted in the servicing position (FIG. 3), at first the coating mechanism 4 and the dosing device 12 are swung upwards into the intermediate position by means of the piston-and-cylinder unit 9 respectively the bellow cylinder 18. The pistons of the piston-and-cylinder units 10, 20 extended to their end positions stop the motion of swivel arms 7, 13 in the intermediate position. The stops 11, 19 are so finely adjusted that during the subsequent retraction of the pistons of piston-and-cylinder units 10, 20 the coating mechanism 4 and the dosing system 12 are moved into their respective working positions. The motion towards the counter-roller 2 in each respective working position is well coordinated in time and takes place precisely so that no undosed paint film is applied and also so that the doctor blade 16 is pressed only very briefly against the uncoated web 3; which means that the doctor blade 16 is swung towards the counter-roller 2 either simultaneously with the coating roller 6 or only with a short delay.

When a joint brought about by splicing is detected by a measuring device not shown in the drawing or a break in the web occurs, the coating roller 6 is at first instantly removed by the piston-and-cylinder unit 10 and pressed into the intermediate position, immediately after that the piston-and-cylinder unit 20 presses also the dosing element 16 very quickly from the working position into the intermediate position. These two motions are also coordinated so that no undosed paint film is produced and that the doctor blade 16 is only in a very brief contact with the uncoated web 3 so that no damage to the doctor blade 16 occurs. After the splice spot is passed, the coating mechanism 4 and the dosing system 12 are brought back into their respective working position at the counter-roller 2 in the aforedescribed manner.

In addition to the very quick swinging of the dosing element 16 and the coating roller 6 to and from the respective working position, the device of the invention has the further great advantage that the positioning in the working positions is not done exclusively by means of the cylinder units 18, respectively 9. The retracting pistons of piston-and-cylinder units 20, 10 on both sides guide the pivot arms 7, 13 with adjustable speed exactly and evenly on both sides without tilting the doctor beam 15, respectively the coating roller 6 in their respective working positions. These can be set simply and very accurately by means of stops 19, 11.

I claim:

1. An apparatus for coating a web of material with a flowable substance, said apparatus comprising:

a counter-roller against which a traveling web of material to be coated lies;

a coating mechanism including a coating element for transferring said flowable substance to said web juxtaposed with an upstream portion of said web against said counter-roller, said coating mechanism including a first pair of pivotable arms carrying said coating element and swingable from a servicing position wherein said coating element is spaced a first distance from said counter-roller into a position wherein said coating element is proximal to said counter-roller, and first fluid-operated means connected with said first pair of pivotable arms for displacing said first pair of arms between said positions thereof, said first pair of arms further having a working position in which said coating element presses against said web;

a dosing mechanism including a dosing element for removing excess flowable substance from said web, juxtaposed with a downstream portion of said web against said counter-roller, said dosing mechanism including a second pair of pivotable arms carrying said dosing element and swingable from a servicing position wherein said dosing element is spaced a second distance from said counter-roller into a position wherein said dosing element is proximal to said counter-roller, and second fluid-operated means connected with said second pair of pivotable arms for displacing said second pair of arms between said positions;

a hydraulic piston-and-cylinder unit acting upon one of the pairs of arms only when the respective fluid-operated means displace the respective element so as to be proximal to the counter roller for swinging the respective pair of arms from the respective working position into an intermediate position spacing the respective element from the web at a distance less than the respective first or second distance; and an adjustable stop against which said hydraulic piston-and-cylinder unit bears for precisely establishing said intermediate position.

2. The apparatus defined in claim 1, further comprising a stand, said first and second pairs of arms being pivotally connected to said stand, said unit being provided on said one of said pairs of arms, said stop being mounted on said stand.

3. The apparatus defined in claim 2 wherein each of said pairs of arms is provided with a respective hydraulic piston-and-cylinder unit acting upon the respective pair of arms for swinging the respective pair of arms from the respective working position into a respective intermediate position spacing the respective element from the web.

4. The apparatus defined in claim 3 wherein each of said hydraulic piston-and-cylinder units is provided with a respective adjustable stop on said stand against which the respective hydraulic piston-and-cylinder unit bears for precisely establishing the respective intermediate position.

* * * * *